United States Patent [19]

Ojanen et al.

[11] Patent Number: 4,728,153

[45] Date of Patent: Mar. 1, 1988

[54] CYLINDRICAL RETAINER FOR A CUTTING BIT

[75] Inventors: Randall W. Ojanen, Bristol, Tenn.; John R. Anderson, Naugatuck, Conn.

[73] Assignee: GTE Products Corporation, Danvers, Mass.

[21] Appl. No.: 944,785

[22] Filed: Dec. 22, 1986

[51] Int. Cl.[4] ..... E21C 25/12

[52] U.S. Cl. ..... 299/92; 299/86

[58] Field of Search ..... 299/79, 81, 86, 91, 299/92; 37/142 A; 175/410

[56] References Cited

U.S. PATENT DOCUMENTS 3,397,012 8/1968 Krekeler ..... 299/92 X 4,333,687 6/1982 Barnstorf ..... 299/86 X 4,484,783 11/1984 Emmerich ..... 299/92 X

FOREIGN PATENT DOCUMENTS 646047 2/1979 U.S.S.R. ..... 37/142 A

*Primary Examiner*—Stephen J. Novosad

*Assistant Examiner*—David J. Bagnell

*Attorney, Agent, or Firm*—David J. Koris

[57] ABSTRACT

A cylindrical retainer which retains a cutting bit in a bore of a bit mount of a cutting tool, including a circumferential inner ridge which extends into a corresponding groove in the bit, and a plurality of circumferentially, spaced protuberances which bear against the wall of the bore.

18 Claims, 4 Drawing Figures

CYLINDRICAL RETAINER FOR A CUTTING BIT

BACKGROUND OF THE INVENTION

1. Field of the Invention

The present invention relates to a cylindrical retainer for mounting a cutting bit to a cutting tool bit mount.

2. Description of the Prior Art

Bits that are used in mining and for removing road surfaces are typically mounted in a machine having a power driven cutter wheel. The wheel has an array of cutter bits mounted on the rim which attack the material to be broken. Each bit desirably includes a hard insert typically made of a carbide material.

One example of such a bit is described in U.S. Pat. No. 4,497,520 to Randell W. Ojanen. In this patent, a rotatable bit 11 is provided as depicted in FIG. 1. Such a bit includes a head portion 13 and a depending shank portion 15. The head portion 13 and shank 15 are coaxially aligned with the head 13 having an enlarged section 17 which prevents the head 13 from being forced into the opening in the mounting block 19. A hard insert 23 typically made of a carbide material is fixedly secured to the forward end of the head 13. The shank portion 15 which is a cylindrical configuration includes a split sleeve 21. The split sleeve 21 is an open ended generally cylindrical-type member through which the shank 15 extends, the sleeve being held in place between an enlarged section 17 and by an enlarged end portion of the shank. When the bit 11 is mounted to the mounting block 19, split sleeve 21 is radially contracted when present in the opening in the mounting block so as to hold the bit 11 in the block 19.

Another example is described in U.S. Pat. No. 4,201,421 to Leroy E. Den Besten et al. In this patent a split tubular open ended spring sleeve 4 is located on the shank 7 of the cutting bit 3 and resiliently engages the inner surface of sockets 10 to secure the bit to the mount 2 in such a manner as to allow the bit to rotate.

In the Ojanen and Den Besten et al patents an enlarged end portion of the shank extends from an open end of the split sleeve bit retainer to hold the retainer in place. In such structure the split sleeve bit retainer covers less than the entire length of the shank of the bit. Accordingly, as the bit rotates the split sleeve provides protection from wear for less than the entire length of the bore into which the shank and retainer are inserted. In addition, since the sleeve is split ease of rotation of the bit is less than optimum since there is less than 360° coverage of the bore. Further, in those instances as in the Ojanen patent wherein the bore into which the shank is inserted extends entirely through the mounting block there is a tendency for foreign material to enter the rear of the bore. The introduction of such foreign matter will have an adverse affect on the wear and rotation of the shank.

It is desirable that a bit retainer be provided which covers the entire length of the shank of the bit so that as the bit rotates during use the retainer provides protection form wear for the entire length of the bore into which the shank and retainer are inserted.

It is also desirable that a bit retainer be provided wherein there is 360° coverage of the bore into which the shank and retainer are inserted so that ease of rotation of the bit is optimized.

It is further desirable in those instances where the mounting bore is a through bore to provide a bit retainer wherein foreign material is prevented from entering the rear of the bore into which the shank and retainer are inserted.

SUMMARY OF THE INVENTION

This invention achieves these and other objects by providing a cylindrical retainer for use with a cutting bit having a first end which forms a cutting head and a second end forms a cylindrical shank. The cutting bit is mountable to a cutting tool bit mount by inserting the cylindrical shank into the cylindrical retainer and inserting the cylindrical retainer into a cylindrical bore of the mount, the cylindrical bore having an inner cylindrical surface. The cutting head is wider than the diameter of the cylindrical bore to prevent the cutting head from entering the cylindrical bore. The cylindrical shank includes a circumferential groove extending about the peripheral surface of the shank. The cylindrical retainer comprises an outer cylindrical wall having a diameter which is less than the diameter of the cylindrical bore and an inner cylindrical wall having a diameter which is greater than the diameter of the cylindrical shank. The length of the walls is sufficient to completely separate the shank from the cylindrical surface. One end of the cylindrical member is open and an opposite end is closed. means are provided protruding from the inner cylindrical wall having a diameter which is less than the diameter of the cylindrical shank but which can be expanded by the cylindrical shank and then caused to snap into the circumferential groove, when the cylindrical shank is inserted at the open end into the cylindrical retainer, for retaining the cylindrical shank within the cylindrical retainer. Means is also provided protruding from the outer cylindrical wall having an effective diameter which is greater than the diameter of the cylindrical bore but which can be depressed by the cylindrical surface of the cylindrical bore and caused to bear against the cylindrical surface, when the cylindrical retainer is inserted at the closed end into the cylindrical bore, for retaining the cylindrical retainer within the cylindrical bore.

DESCRIPTION OF THE PREFERRED EMBODIMENT

Figure 1:
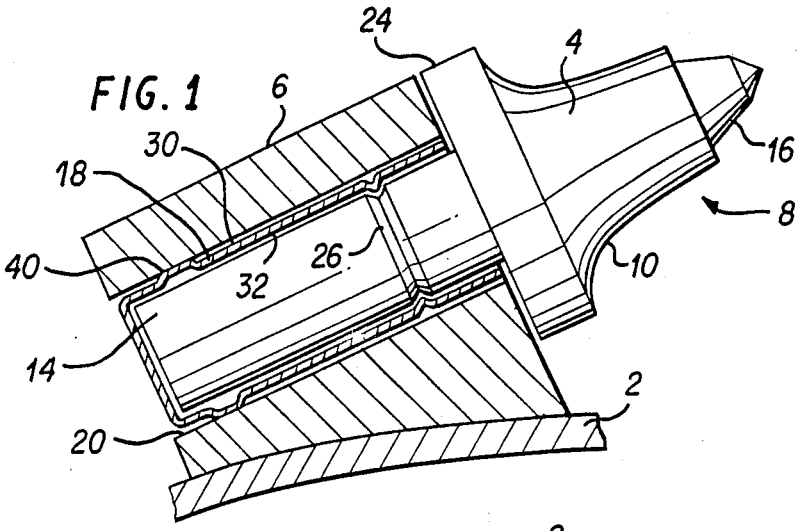
FIG. 1 is a partially sectioned view of the bit, cylindrical retainer, bit mount and cutting tool, of the present invention.
Figure 2:
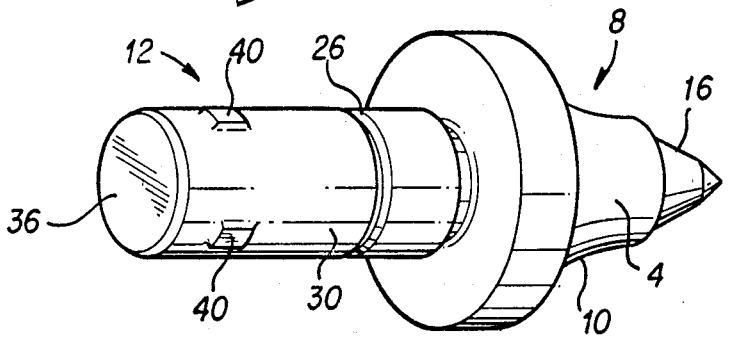
FIG. 2 is a perspective view of the bit and cylindrical retainer of FIG. 1.
Figure 3:
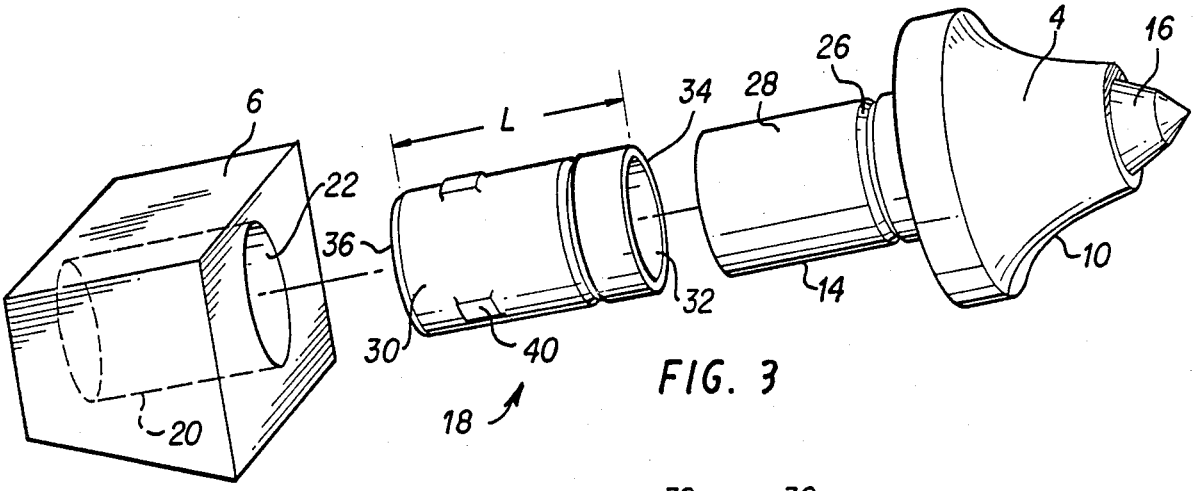
FIG. 3 is an exploded view of the bit, cylindrical retainer and mount of FIG. 1; and, FIG. 4 is a perspective view of the cylindrical retainer of the present invention.
Figure 4:
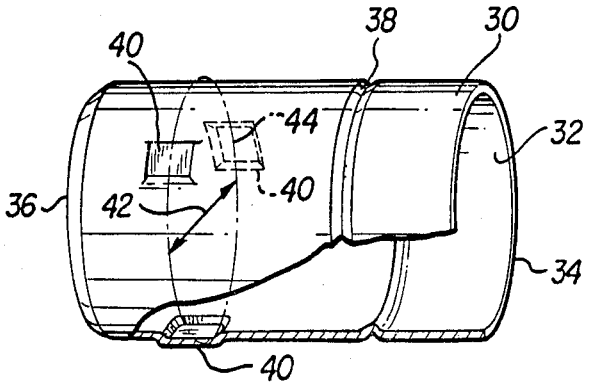

The embodiment of this invention which is illustrated in the drawings is particularly suited for achieving the objects of this invention. FIG. 1 is representative of a rotary cutting tool in the form of a power driven cutter wheel having an array of cutting bits mounted on the rim which attack the material to be cut as the wheel rotates. In order to simplify the drawings only a portion of such a cutter wheel 2 and only one such cutting bit 4 are depicted. Each of the cutting bits 4 are supported by a bit mount 6. Each cutting bit 4 includes a first end 8 which forms a cutting head 10 and a second end 12 which forms a cylindrical shank 14. Each bit desirably includes a hard insert 16 typically made of a carbide material. The cutting bits 4 are mountable to the bit mounts 6 by inserting the cylindrical shank 14 into a cylindrical retainer 18 and inserting the cylindrical retainer 18 into a cylindrical bore 20 of the mount, the cylindrical bore having a cylindrical surface 22 to accommodate the cylindrical retainer. The cutting head 10 of the cutting bit 4 is wider than the diameter of the bore in order to prevent the cutting head from entering the bore. For example, it will be noted that the first end 8 of the bit 4 is wider at the flanged area 24 than the diameter of the bore 16. The cylindrical shank 14 includes a circumferential groove 26 extending completely about the peripheral surface 28 of the shank.

The cylindrical retainer 18 of FIGS. 1 to 4 includes an outer cylindrical wall 30 having a diameter which is less than the diameter of cylindrical bore 20 and an inner cylindrical wall 32 having a diameter which is greater than the diameter of the cylindrical shank 14. It will be apparent from FIGS. 1 and 3 that the length L of the walls 30 and 32 is sufficient to completely separate the entire portion of shank 14 positioned in bore 20 from the cylindrical surface 22 of the bore. The cylindrical retainer 18 includes one end 34 which is open and an opposite end 36 which is closed.

The cylindrical retainer 18 includes means, such as ridge 38, protruding from the inner cylindrical wall 32 having a diameter which is less than the diameter of the cylindrical shank but which can be expanded by the shank and then caused to snap into the circumferential groove 26, when the shank is inserted at open end 34 into the retainer 18, for retaining the shank within the retainer. For example, when the shank 14 is outside of the retainer 18, ridge 38 protrudes from inner wall 32 with an inner diameter which is less than the diameter of shank 14. As the shank 14 is partially inserted into retainer 18, the shank engages the ridge 38 causing it to expand to accommodate the shank. When the shank 14 is fully inserted into retainer 18, ridge 38 will snap into groove 26 and retain the shank within the retainer, the diameter of the ridge once again being less than the diameter of the shank.

The cylindrical retainer 18 includes means, such as a plurality of circumferentially spaced protuberances 40, protruding from the outer cylindrical wall 30 having an effective diameter which is greater than the diameter of the cylindrical bore 20 but which can be depressed by the cylindrical surface 22 of the bore so that the protuberances are caused to bear against surface 22, when the retainer is inserted at closed end 36 into bore 20, for retaining the retainer within the bore. For example, when the retainer 18 is outside of the bore 20, protuberances 40 protrude from wall 30 with an effective diameter 42 which is greater than the diameter of the bore 20. As the retainer is inserted into bore 20, the protuberances 40 engage the surface 22 and are thereby depressed so that the retainer can be forced into the bore. When the retainer is fully inserted into the bore, the protuberances 40 bear against surface 22, and the force fit thereby created retains the retainer within the bore. The effective diameter 42 is the diameter of a hypothetical circumferencial line 44 engaging the high points of the protuberances 40. In the embodiment depicted in the drawings the plurality of circumferentially spaced protuberances includes three protuberances 40 spaced at 120° from each other.

In the preferred embodiment, cylindrical retainer 18 is formed from metal such as spring steel which allows the cylindrical retainer retaining means such as the protuberances 40, to become expanded and depressed, respectively, as described herein.

It is believed that the advantages of the present invention will be apparent from the description herein and the drawings. A cylindrical retainer is provided which covers the entire length of the shank of the bit so that as the bit rotates during use the retainer will provide protection from wear for the entire length of the bore into which the shank and retainer are inserted. Since there is 360° coverage of the bore into which the shank and retainer are inserted, the ease of rotation of the bit during use is optimized. In the embodiment of FIG. 1 wherein the mounting bore 20 is a through bore; that is, extends through the mount 6, foreign material is prevented from entering the rear of the bore by means of the closed end 36 of the retainer. And although the internal diameter of the ridge 38 will expand to allow insertion of the tool shank, when the bit and retainer are inserted into the bore 20 of the mount 6, bore surface 22 will restrict expansion of the ridge to thereby retain the shank within the bore.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A cylindrical retainer for use with a cutting bit having a first end which forms a cutting head and a second end which forms a cylindrical shank, said cutting bit being mountable to a bit mount by inserting said cylindrical shank into said cylindrical retainer and inserting said cylindrical retainer into a cylindrical bore of said mount, said cylindrical bore having a cylindrical surface, said cutting head being wider than the diameter of said cylindrical bore to prevent said cutting head from entering said cylindrical bore, and said cylinrical shank including a circumferential groove extending about the peripheral surface of said cylindrical shank, said cylindrical retainer comprising:

an outer cylindrical wall having a diameter which is less than the diameter of said cylindrical bore and an inner cylindrical wall having a diameter which is greater than the diameter of said cylindrical shank, the length of said walls being sufficient to completely separate said shank from said cylindrical surface, said cylindrical retainer having one end which is open and an opposite end which is closed;

means protruding from said inner cylindrical wall having a diameter which is less than the diameter of said cylindrical shank but which can be expanded by said cylindrical shank and then caused to snap into said circumferential groove, when said cylindrical shank is inserted at said open end into said cylindrical retainer, for retaining said cylindrical shank within said cylindrical retainer; and, means protruding from said outer cylindrical wall having an effective diameter which is greater than the diameter of said cylindrical bore but which can be depressed by said cylindrical surface of said cylindrical bore and caused to bear against said cylindrical surface, when said cylindrical retainer is inserted at said closed end into said cylindrical bore, for retaining said cylindrical retainer within said cylindrical bore.

2. The cylindrical retainer of claim 1 wherein said cylindrical shank retaining means includes a circumferential ridge.

3. The cylindrical retainer of claim 2 wherein said cylindrical retainer retaining means includes a plurality of circumferentially, spaced protuberances.

4. The cylindrical retainer of claim 3 wherein said plurality of circumferentially, spaced protuberances includes three protuberances spaced at 120° from each other.

5. The cylindrical retainer of claim 1 wherein said cylindrical retainer retaining means includes a plurality of circumferentially, spaced protuberances.

6. The cylindrical retainer of claim 3 whereinn said plurality of circumferentially, spaced protuberances includes three protuberances spaced at 120° from each other.

7. A rotatable cutting tool of the type having a plurality of bit mounts each of which carry a cutting bit, each cutting bit having a first end which forms a cutting head and a second end which forms a cylindrical shank, each cutting bit being mountable to said bit mount by inserting said cylindrical shank into a cylindrical retainer and inserting said cylindrical retainer into a cylindrical bore of said mount, said cylindrical bore having a cylindrical surface, said cutting head being wider than the diameter of said cylindrical bore to prevent said cutting head from entering said cylindrical bore, and said cylindrical shank including a circumferential groove extending about the peripheral surface of said cylindrical shank, the improvement comprising:

a cylindrical retainer including an outer cylindrical wall having a diameter which is less than the diameter of said cylindrical bore and an inner cylindrical wall having a diameter which is greater than the diameter of said cylindrical shank, the length of said walls being sufficient to completely separate said shank from said cylindrical surface, said cylindrical retainer having one end which is open and an opposite end which is closed;

means protruding from said inner cylindrical wall having a diameter which is less than the diameter of said cylindrical shank but which can be expanded by said cylindrical shank and then caused to snap into said circumferential groove, when said cylindrical shank is inserted at said open end into said cylindrical retainer, for retaining said cylindrical shank within said cylindrical retainer; and, means protruding from said outer cylindrical wall having a diameter which is greater than the diameter of said cylindrical bore but which can be depressed by said cylindrical surface of said cylindrical bore and caused to bear against said cylindrical surface, when said cylindrical retainer is inserted at said closed end into said cylindrical bore, for retaining said cylindrical retainer within said cylindrical bore.

8. The cylindrical retainer of claim 7 wherein said cylindrical shank retaining means includes a circumferential ridge.

9. The cylindrical retainer of claim 8 wherein said cylindrical retainer retaining means includes a plurality of circumferentially, spaced protuberances.

10. The cylindrical retainer of claim 9 wherein said plurality of circumferentially, spaced protuberances includes three protuberances spaced at 120° from each other.

11. The cylindrical retainer of claim 7 wherein said cylindrical retainer retaining means includes a plurality of circumferentially, spaced protuberances.

12. The cylindrical retainer of claim 11 wherein said plurality of circumferentially, spaced protuberances includes three protuberances spaced at 120° from each other.

13. The combination of a cutting bit and a cylindrical retainer, said cutting bit comprising a first end which forms a cutting head and a second end which forms a cylindrical shank, said cutting bit being mountable to a bit mount by inserting said cylindrical shank into a cylindrical retainer and inserting said cylindrical retainer into a cylindrical bore of said mount, said cylindrical bore having a cylindrical surface, said cutting head being weider than the diameter of said cylindrical bore to prevent said cutting head from entering said cylindrical bore, and said cylindrical shank including a circumferential groove extending about the peripheral surface of said cylindrical shank; and, said cylindrical retainer comprising an outer cylindrical wall having a diameter which is less than the diameter of said cylindrical bore and an inner cylindrical wall having a diameter which is greater than the diameter of said cylindrical shank, the length of said walls being sufficient to completely separate said shank from said cylindrical surface, said cylindrical retainer having one end which is open and an opposite end which is closed; means protruding from said inner cylindrical wall having a diameter which is less than the diameter of said cylindrical shank but which can be expanded by said cylindrical shank and then caused to snap into said circumferential groove, when said cylindrical shank is inserted at said open end into said cylindrical retainer, for retaining said cylindrical shank within said cylindrical retainer; and, means protruding from said outer cylindrical wall having an effective diameter which is greater than the diameter of said cylindrical bore but which can be depressed by said cylindrical surface of said cylindrical bore and caused to bear against said cylindrical surface, when said cylindrical retainer is inserted at said closed end into said cylindrical bore, for retaining said cylindrical retainer within said cylindrical bore.

14. The cylindrical retainer of claim 13 wherein said cylindrical shank retaining means includes a circumferential ridge.

15. The cylindrical retainer of claim 14 wherein said cylindrical retainer retaining means includes a plurality of circumferentially, spaced protuberances.

16. The cylindrical retainer of claim 15 wherein said plurality of circumferentially, spaced protuberances includes three protuberances spaced at 120° from each other.

17. The cylindrical retainer of claim 13 wherein said cylindrical retainer retaining means includes a plurality of circumferentially, spaced protuberances.

18. The cylindrical retainer of claim 17 wherein said plurality of circumferentially, spaced protuberances includes three protuberances spaced at 120° from each other.

* * * * *